United States Patent [19]

Hamrick

[11] Patent Number: 4,875,694

[45] Date of Patent: Oct. 24, 1989

[54] MECHANICS CREEPER APPARATUS

[76] Inventor: Jerry O. Hamrick, 4987 Northlawn Dr., San Jose, Calif. 95130

[21] Appl. No.: 700,530

[22] Filed: Feb. 11, 1985

[51] Int. Cl.[4] ..... B25H 5/00

[52] U.S. Cl. ..... 280/32.6; 280/87.01; D21/74

[58] Field of Search ..... 280/32.5, 32.6, 87.01; 296/20; D21/74; 180/21

[56] References Cited

U.S. PATENT DOCUMENTS

| | | | |
|---|---|---|---|
| 885,977 | 4/1908 | Brown | 280/87.01 |
| 920,553 | 5/1909 | Farland et al. | 280/32.6 |
| 1,446,945 | 2/1923 | Sunderland | 280/32.6 |
| 1,831,408 | 11/1931 | Cremer | 280/32.6 |
| 2,124,389 | 7/1938 | Woelfer, Jr. | 280/32.6 |
| 2,291,094 | 7/1942 | McCarthy | 280/32.6 |
| 3,828,876 | 8/1974 | Morelli | 180/21 |
| 4,244,594 | 1/1981 | Hines | 280/32.6 |

*Primary Examiner*—Charles A. Marmor
*Assistant Examiner*—Eric Culbreth
*Attorney, Agent, or Firm*—Rosenblum, Parish & Bacigalupi

[57] ABSTRACT

An improved mechanic's creeper including a flat, generally rectangularly configured platform, the four corner portions of which may be tapered for streamlining. The device includes a longitudinal support axis (axis of symmetry) along which are positioned head end and foot end casters, and a transverse support axis disposed nearer the foot end of the platform than to the head end and along which are positioned side casters. Upstanding fenders are disposed at the four caster locations for mounting the caster devices to the platform. A head rest is also provided at the head end of the device and extends over the fender disposed at the head end.

12 Claims, 3 Drawing Sheets

MECHANICS CREEPER APPARATUS

BACKGROUND OF THE INVENTION

1. Field of the Invention

The present invention relates generally to mechanic's creeper devices and more particularly to an improved creeper device designed to better support the weight of the user and prevent unintentional motion of the apparatus when in use.

2. Description of the Prior Art

Creeper devices have been used by mechanics for more than fifty years to permit easy access to the bottom of a automobile or other mechanism for maintenance or repair purposes. Typically, the creepers are comprised of a more or less rectangular, flat platform with a head cushion at one end and caster wheels positioned proximate each corner. Examples of such prior art devices are shown in the 1923 patent to L. E. Sunderland, U.S. Pat. No. 1,446,945 and the more recent patent to Hines U.S. Pat. No. 4,244,594.

One of the problems associated with prior art devices of this type is addressed by Heines; namely, the problem of having one end of the device raise during the dismounting process or when the user merely sits up on the device. In most commercially available creepers, the wheels are positioned somewhat inboard of the actual ends of the device such that the buttocks of the user is positioned very near the foot end thereof. Accordingly, when he sits up on the device and his weight is distributed outboard of the foot support axis, the head of the device is often caused to rotate upwardly and slip out from under him. Heines addresses this problem by providing a downwardly extending brake strip at the foot end of the creeper which, upon dismounting, is caused to engage the ground and prevent the undesired rotation and consequent movement of the device.

Another problem with prior art devices is that because the wheels at the head end thereof are positioned approximately beneath the shoulders of the user, if the user attempts to apply substantial force to a wrench or other leverage working apparatus, the creeper will slip sideways or perhaps longitudinally making it difficult to apply maximum force to the workpiece.

Still another problem is that in most conventional devices, the height of the user support surface is dictated by the size of the casters which must be placed therebeneath. Since this height is typically 3 to 4 inches above the ground surface, it means that the required clearance beneath the vehicle and ground must be at least 3 or 4 inches more than the workman's body clearance requirements.

SUMMARY OF THE PRESENT INVENTION

It is therefore an object of the present invention to provide an improved creeper device having an unconventional positioning of the casters so as to provide features which have heretofore not been available in the prior art.

Another object of the present invention is to provide an improved creeper device having a user support platform which is disposed substantially lower relative to the ground surface than is possible in prior art devices.

Still another object of the present invention is to provide a novel creeper device wherein the shoulder support portions of the device may be grounded so as to enable the user to obtain maximum leverage when applying force to a part being operated upon.

Briefly, a preferred embodiment of the invention includes a flat, generally rectangularly configured platform, the four corner portions of which may be tapered for streamlining. The device includes a longitudinal support axis (axis of symmetry) along which are positioned head end and foot end casters, and a transverse support axis disposed nearer the foot end of the platform than to the head end and along which are positioned side casters. Upstanding fenders are disposed at the four caster locations to provide means for mounting the caster devices to the platform. A head rest is also provided at the head end of the device and extends over the fender disposed at the head end.

A primary advantage of the present invention is that it provides a three-point suspension at the buttocks supporting portion such that when the user is in a sitting position, he is in a stable support position.

Another advantage of the present invention is that the upper torso supporting portion is also supported by a three-point suspension except that the head caster is positioned more remote from the side casters than is the foot caster thereby allowing easier tilting of the platform for grounding purposes during force applying operations.

Still another advantage is that the device is simply configured so as to provide for economical construction and efficient use of materials.

These and other objects and advantages of the present invention will no doubt become apparent to those skilled in the art after having read the following detailed description of the preferred embodiment illustrated in the several figures of the drawing.

IN THE DRAWING

DESCRIPTION OF THE PREFERRED EMBODIMENT

Figure 1:
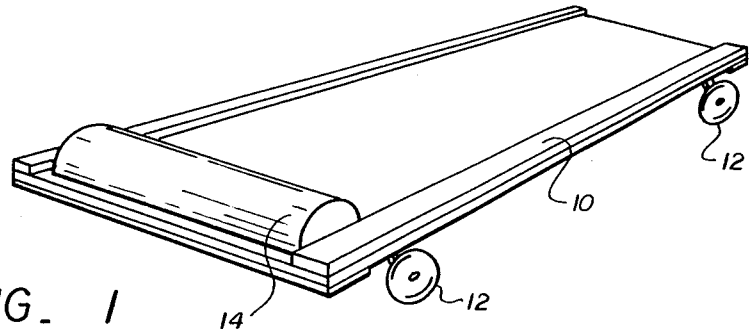
FIG. 1 PRIOR ART
FIG. 1 is a perspective illustration showing a prior art creeper device.
Figure 2:
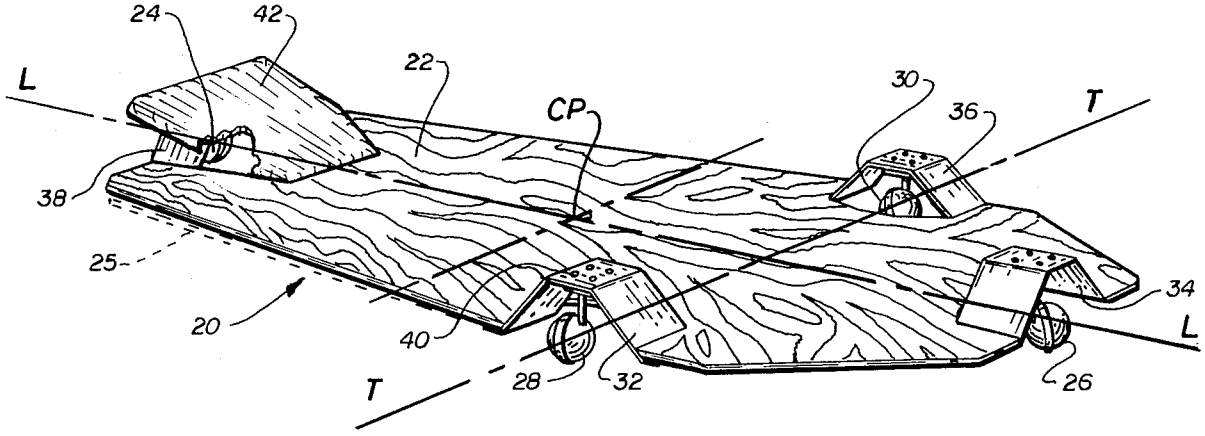
FIG. 2 is a perspective illustration showing a preferred embodiment of a creeper in accordance with the present invention.

Referring now to FIG. 1 of the drawing, a prior art creeper device is shown for illustrative purposes. As described generally above, the prior at device includes a rectangular platform 10, four casters 12 respectively disposed proximate each corner of the platform 10, and a head rest 14 at the head end of the device. As will be appreciated, this configuration is subject to all of the disadvantages mentioned above.

Referring now to FIGS. 2–5 of the drawing, a preferred embodiment of an improved creeper in accordance with the present invention is shown at 20. The device includes a flat horizontal platform 22 which is, in the preferred embodiment, cut from a sheet of ⅝ inch or larger plywood. The device includes a head end caster 24 and a foot end caster 26 disposed along a longitudinal axis of symmetry L—L, and a pair of side casters 28 and 30 disposed along a transverse support axis T—T. Although the transverse support axis T-T could be positioned at any point between the longitudinal center point CP and the foot end of the platform, it is preferable that axis T—T be positioned at approximately ⅓ of the length of the platform from the foot end thereof.

Figure 5:
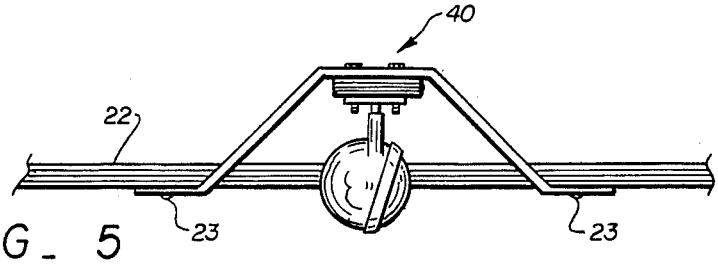
FIG. 5 is an enlarged partial elevation showing caster mounting details.
Figure 3:
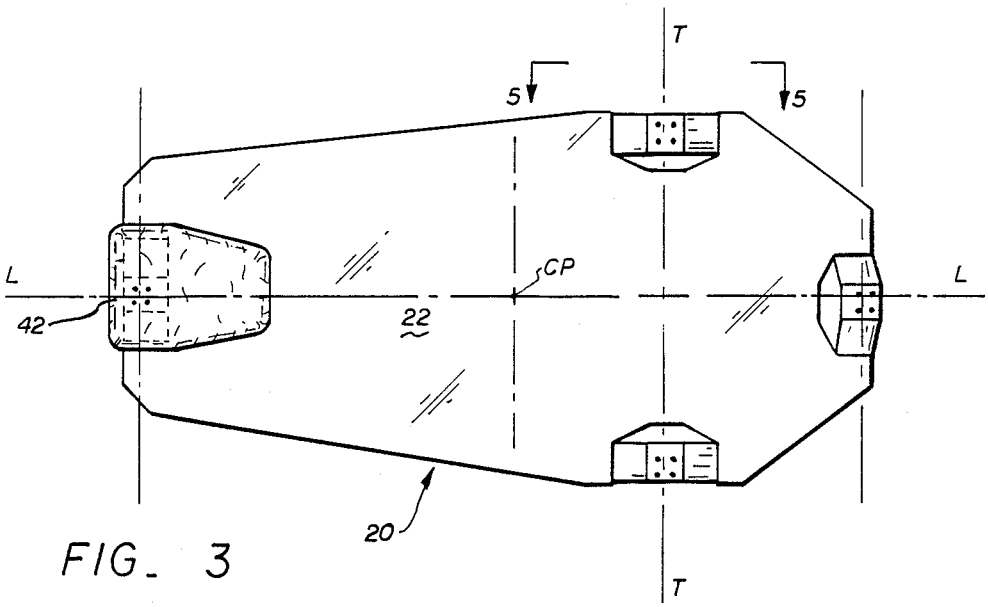
FIG. 3 is a plan view thereof.

In order that the platform 22 may be positioned low relative to the ground or other support surface while still enabling the use of commercially available casters, four upstanding fender structures 32, 34, 36 and 38 are fastened to platform 22 at cutouts provided in the platform as indicated. The fenders are attached to platform 22 by means of wood screws 23 or the like (FIG. 5). The upper brackets of the casters are bolted or otherwise fastened to the top portions of the fenders as indicated at 40.

Disposed at the head end of the device is a suitable padded head rest 42 which extends over fender 38 to comfortably support the head of a user.

Figure 4:
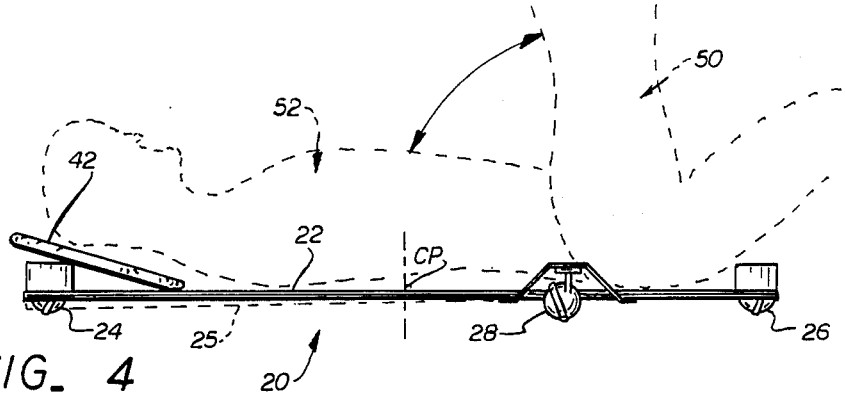
FIG. 4 is a side elevation thereof.

In use, a mechanic will seat himself with his buttocks on the side of the transverse axis T—T closest to the foot end of the platform as illustrated by the dashed lines 50 in FIG. 4. In such position, it will be appreciated that his weight will be primarily supported by the three point support of casters 26, 28 and 30, and he will be free to move the device about the supporting floor or surface in a stable, controlled manner. Note that the fenders 32 and 36 are positioned with separation suitable to provide adequate hip clearance and the legs of the user will straddle fender 34. When ready to move beneath a vehicle, the user will lay back into the reclined positioned, shown at 52, with his head supported by head rest 42, and in such position is free to move the device with his body being supported by all four of the casters.

Once in position beneath a vehicle to be repaired, if the user attempts to apply a force which provide unequal loads to the sides of the platform 22, the loaded side thereof will tilt, as indicated by the dashed line 25 in FIG. 4, and engage the support surface thereby providing a braking action tending to resist lateral motion and consequently allow the user to apply a more substantial force to the wrench or other tool. However, once the force is released and the user's weight is again evenly distributed relative to the longitudinal axis of the platform, the depressed edge will return to its normal raised position and the platform can be easily moved to a new location.

Although many of the advantages of the present invention will be apparent to those skilled in the art, it will also be appreciated that because the casters are positioned along longitudinal and transverse axes, if one of the casters should enter a crack or other depression, it can be easily removed therefrom or caused to skip over such depression, by a simple torquing of the users body.

Another advantage is that the apparatus can be made from readily available materials. For example, although in the preferred embodiments, the platform 22 is made of plywood, it could just as easily be made from molded fiberglass or from a sheet of plastic or even from a sheet of suitable metal. In the preferred embodiment, the fenders 32–38 are made of aluminum and are pre-bent to have lower flanges which are fastened to the bottom surface of platform 22 by screws 23 or other suitable fastening means as described above.

Although the present invention has also been illustrated as being configured with certain tapers at the head and foot portions thereof, it will be appreciated that the perimeter could take on any suitable configuration. For example, lateral extensions may be included to provide tool support shelves with perhaps parts containers mounted on portions thereof.

Although a preferred embodiment of the present invention has been disclosed above, it will be appreciated that numerous alterations and modifications thereof will no doubt become apparent to those skilled in the art after having read the above disclosures. It is therefore intended that the following claims be interpreted as covering all such alterations and modifications as fall within the true spirit and scope of the invention.

What is claimed is:

1. An improved creeper apparatus, comprising:

means forming a generally horizontal platform having a longitudinal support axis and axis of symmetry extending from a head end thereof to a foot end thereof, and a transverse support axis extending across the said longitudinal axis at a point between a central point along the longitudinal axis and said foot end; and caster means disposed along said longitudinal support axis at said foot end and said head end, and along said transverse support axis at one side and the other side of said platform, whereby said platform may be easily moved in any horizontal direction by the application of corresponding horizontal forces thereto.

2. An improved creeper apparatus as recited in claim 1 and further comprising upstanding fender means attached to said platform and disposed at points along said longitudinal axis and said transverse axis, said further means extending upwardly relative to said platform and providing wells for receiving said caster means and means for attaching said caster means to said platform.

3. An improved creeper apparatus as recited in claim 2 wherein said transverse support axis intersects said longitudinal support axis at a point approximately ⅓ of the length of said longitudinal support axis from said foot end.

4. An improved creeper apparatus as recited in claim 3 and further comprising a head support means affixed to said platform and extending above the fender disposed at said head end of said platform.

5. An improved creeper apparatus as recited in claim 1 wherein the width of said platform is greater at the position of said transverse support axis than at either end thereof.

6. An improved creeper apparatus as recited in claim 1 wherein said caster means include both vertical and horizontal axes of rotation, and the bottom surface of said platform is lower than the horizontal axes of rotation of said caster means, and wherein the side edges of said platform extending from said head end to the points of intersection with said transverse axis respectively extend laterally outside of straight lines extending between the caster means disposed at said head end and the caster means disposed at each side of said platform, whereby an uneven loading applied to one side edge of said platform at a point approximately midway between the caster means at said head end and the caster means on one side will cause said platform to tilt about said line enough to cause the edge thereof to engage the surface supporting said creeper apparatus and thereby provide a braking action tending to resist any tendency of the apparatus to move as the user applies horizontal forces thereto.

7. An improved creeper apparatus as recited in claim 1 wherein all of said caster means are rotatable about two axes of rotation and the positioning of one of said axes of each said caster means is selected such that all of said caster means simultaneously rest on a planar supporting surface whereby horizontal forces applied to said platform will cause said platform to tend to move in the direction of the applied forces.

8. An improved creeper apparatus as recited in claim 1 and further comprising:

head support means affixed to said platform and extending above the caster disposed at said head end whereby the portion of said platform on the foot end side of said transverse support axis forms a support for the buttocks of a user, the portion of said platform on the head end side of said transverse support axis forms a support for the upper torso of the user, and said head support means forms a support for the head of the user.

9. An improved creeper apparatus as recited in claim 8 and further comprising upstanding fender means attached to said platform and disposed at points along said longitudinal axis and said transverse axis, said fender means extending upwardly relative to said platform and providing wells for receiving said caster means and means for attaching said caster means to said platform.

10. An improved creeper apparatus as recited in claim 8 wherein said transverse support axis intersects said longitudinal support axis at a point approximately $\frac{1}{3}$ of the length of said longitudinal support axis from said foot end.

11. An improved creeper apparatus as recited in claim 8 wherein the width of said platform is greater at the position of said transverse support axis than at either end thereof.

12. An improved creeper apparatus as recited in claim 8 wherein said caster means include both vertical and horizontal axes of rotation, and the bottom surface of said platform is lower than the horizontal axes of rotation of said caster means, and wherein the side edges of said platform extending from said head end to the points of intersection with said transverse axis respectively extend laterally outside of straight lines extending between the caster means disposed at said head end and the caster means disposed at each side of said platform, whereby an uneven loading applied to one side edge of said platform at a point approximately midway between the caster means at said head end and the caster means on one side will cause said platform to tilt about said line enough to cause the edge thereof to engage the surface supporting said creeper apparatus and thereby provide a braking action tending to resist any tendency of the apparatus to move as the user applies horizontal forces thereto.

* * * * *